United States Patent [19]

Adams et al.

[11] Patent Number: 4,832,406

[45] Date of Patent: May 23, 1989

[54] CHAIR WITH COLLAPSIBLE ARMS

[75] Inventors: Bruce Adams, Thomasville; Marta Tornero, Greensboro, both of N.C.

[73] Assignee: MT Design, Greensboro, N.C.

[21] Appl. No.: 141,585

[22] Filed: Jan. 7, 1988

Related U.S. Application Data

[63] Continuation-in-part of Ser. No. 11,934, Feb. 6, 1987, abandoned.

[51] Int. Cl.[4] ..... A47C 7/54

[52] U.S. Cl. ..... 297/417; 297/353; 297/443

[58] Field of Search ..... 297/443, 353, 444, 451, 297/33, 417, 411; 248/282, 276

[56] References Cited

U.S. PATENT DOCUMENTS

| | | | |
|---|---|---|---|
| 64,535 | 5/1867 | Hyde | 297/27 |
| 2,784,769 | 3/1957 | Fisher | 297/443 X |
| 2,955,648 | 10/1960 | Krajewski . | |
| 3,115,366 | 12/1963 | Glass | 297/417 |
| 3,514,153 | 5/1970 | Maurer et al. | 297/330 X |
| 4,099,774 | 7/1978 | Sandham | 297/443 X |
| 4,221,430 | 9/1980 | Frobose | 297/353 |
| 4,244,623 | 1/1981 | Hall et al. | 297/417 |
| 4,248,646 | 2/1981 | Ginsburg | 156/78 |
| 4,252,371 | 2/1981 | Lehnen | 397/27 |

FOREIGN PATENT DOCUMENTS

| | | | |
|---|---|---|---|
| 394383 | 6/1933 | United Kingdom | 297/35 |
| 667013 | 2/1952 | United Kingdom . | |
| 2110925 | 6/1983 | United Kingdom . | |

OTHER PUBLICATIONS

Copy of a page from the Official Gazette showing a portion of the Meiller Patent No. 4,097,088.

*Primary Examiner*—James T. McCall

*Attorney, Agent, or Firm*—Knobbe, Martens, Olson & Bear

[57] ABSTRACT

A chair arm is pivotally movable from a normal raised position to a collapsed position. The chair back is vertically slidably mounted on a support to permit a connection between the forward portion of the arm and the upper end of an arm support to be moved to a position at the rear of the chair seat and the lower end of the backrest, wherein the arm is vertical adjacent the edge of the back, and the strut is horizontal adjacent the edge of the seat.

19 Claims, 3 Drawing Sheets

Fig. 1
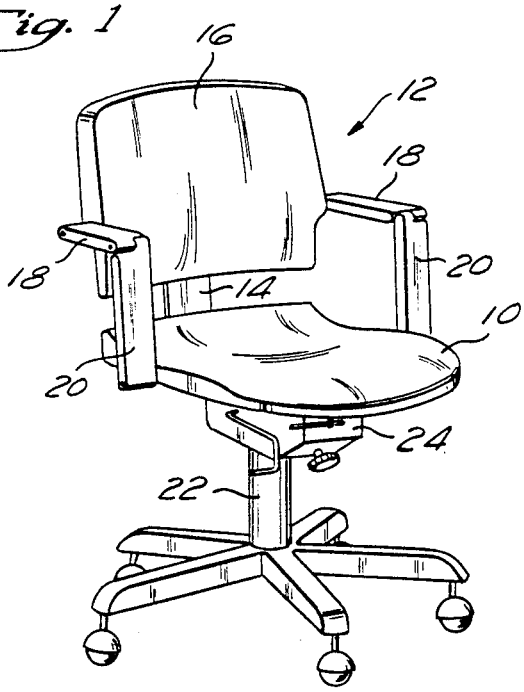
Fig. 2
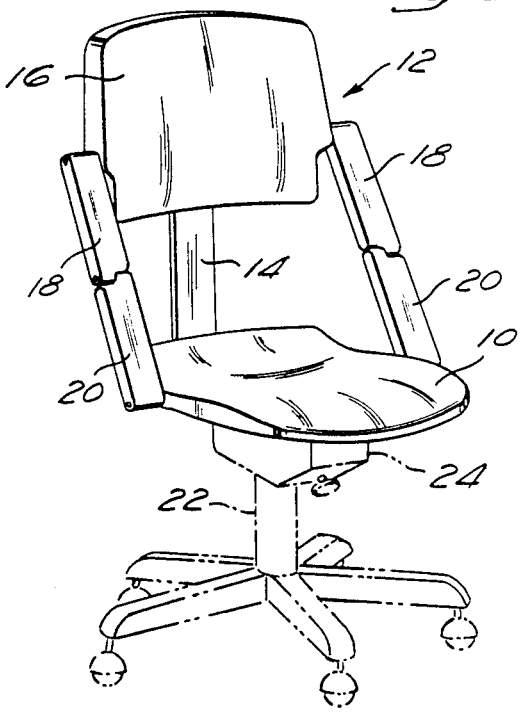
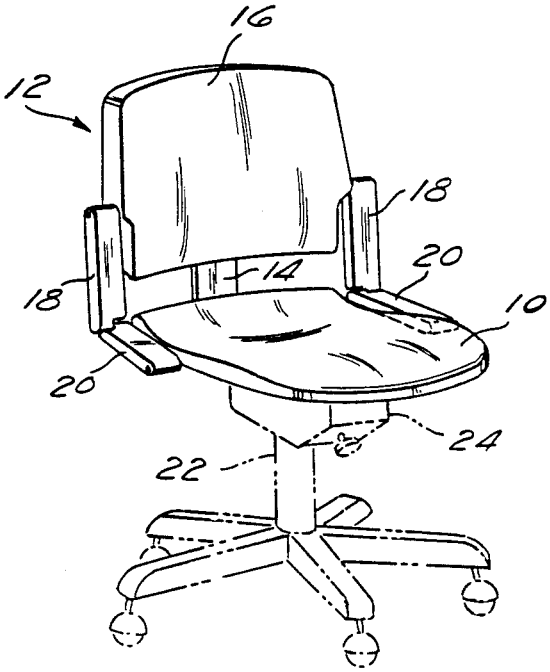
Fig. 3
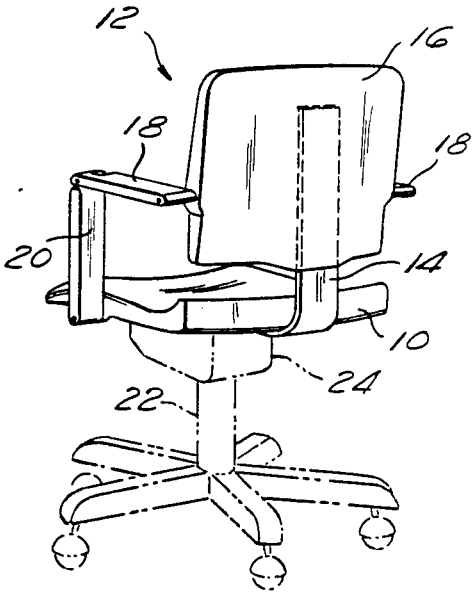
Fig. 4

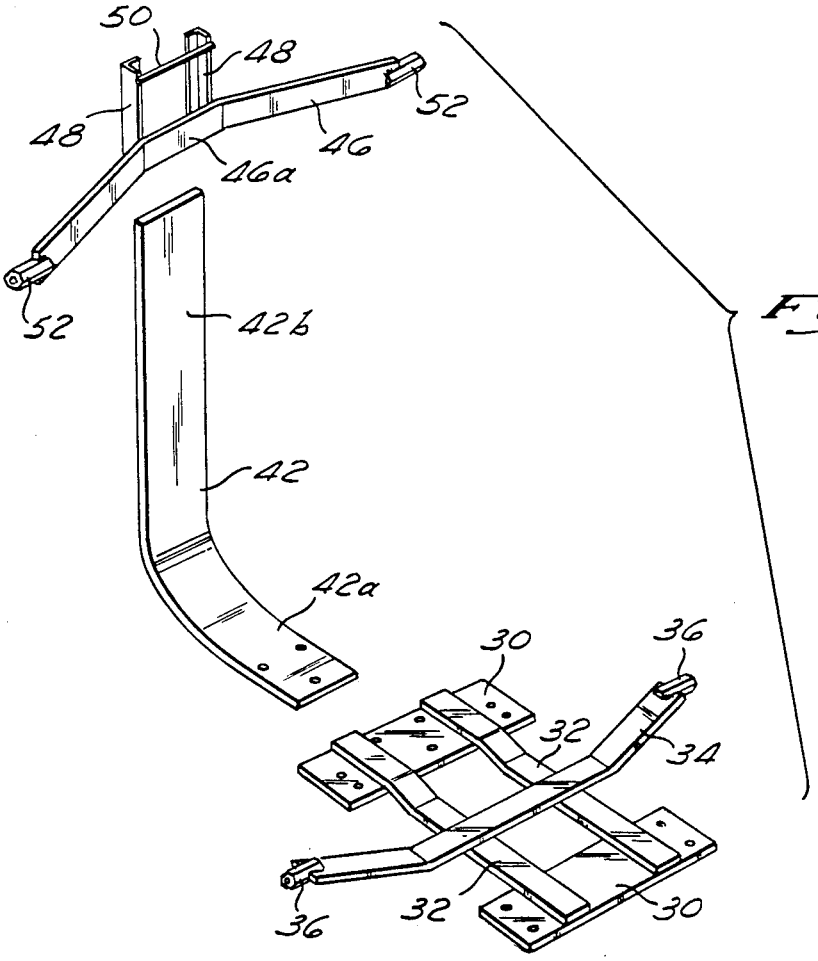
Fig. 5
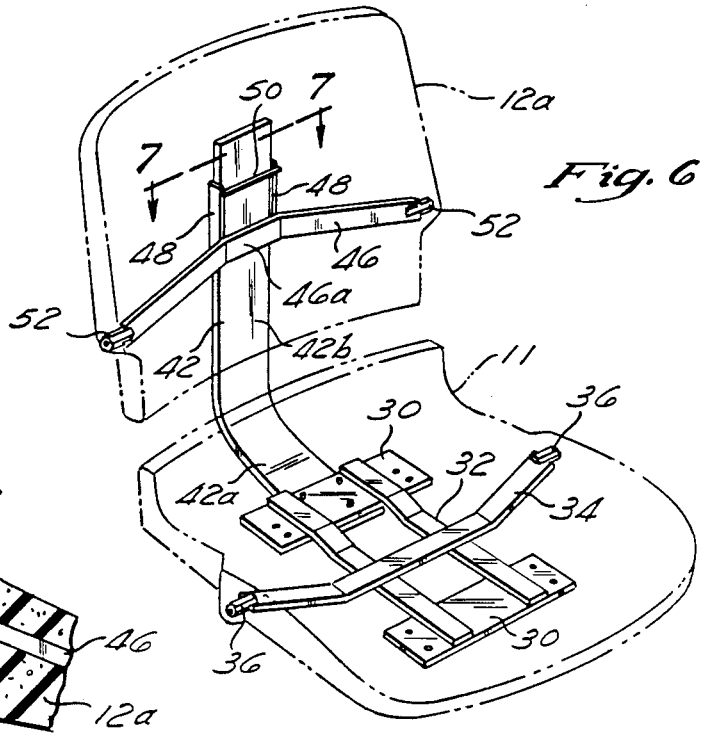
Fig. 6
Fig. 7
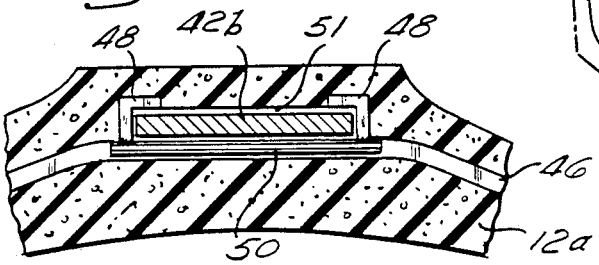

CHAIR WITH COLLAPSIBLE ARMS

CROSS-REFERENCE TO RELATED APPLICATION

This is a patent application No. 011,934 filed Feb. 6, 1987.

FIELD OF THE INVENTION

This invention relates to chair construction, particularly to a convenient arrangement for providing a chair with collapsible arms, and relates to a method of retracting chair arms.

BACKGROUND OF THE INVENTION

Armrests on chairs are convenient and useful items that add to an occupant's comfort. However, armrests can interfere with desks, work stations or other structures, and hence, are undesirable in certain situations. Consequently, some chairs are made with removable armrests. This solution accommodates both situations, but is inconvenient and impractical from the standpoint that the removed armrests must be safely stored when not in use. Also, the removable connections must be sufficiently sturdy but yet be sufficiently simple construction for ease of assembly and disassembly by users not skilled in such activity.

It is also known to have armrests which remain attached to the chair but are movable into different positions. For example, passenger seats in aircraft typically have armrests that are attached to the back of the seat and pivot upwardly in the vertical position when the armrest is not desired. This construction is quite simple and useful, but it requires a very strong back support in that there is no support under the forward end.

U.S. Pat. No. 2,955,648 discloses an armrest supported by a collapsible structure which enables the armrest in one position to be flush with the seat, an in a second position to be elevated. This construction is quite convenient, but it is relatively complicated, expensive and space consuming.

U.S. Pat. No. 4,24,623 discloses a multi-position armrest that employs a linkage that supports an armrest in essentially cantilever fashion that is quite versatile. The armrests can be positioned in a conventional raised configuration, a lowered position flush with the seat, a vertical position where the armrests are parallel to the chair back, and an intermediate position where the forward portions of the armrests are tilted downwardly while the rear portions are raised. Although the arrangement appears to be convenient and comfortable, however, it appears relatively expensive and bulky.

U.S. Pat. No. 4,244,623 also makes reference to U.S. Pat. No. 4,097,088 which is said to have an armrest pivotally attached at two points to two links carried by the seat frame so as to permit movement of the armrest to several generally parallel positions.

British Patent No. 344,383 discloses a chair which is collapsible for storage and includes an armrest that is pivotally attached to a chair back, and is hinged at its forward end to a supporting member which in turn is hinged to the chair seat. The chair is designed to have the armrest only in a raised conventional position when in use.

In spite of the above-mentioned chair constructions, a need exists for an improved chair armrest that can be easily moved into and out of an operative position, and is also sturdy and attractive.

SUMMARY OF THE INVENTION

Briefly stated, a chair arm is movably attached at its rear end to the back of a chair and is movably attached at its forward end to the upper end of a support strut which in turn is movably attached at its lower end to the chair seat. The arm and its support strut are movable from a raised position wherein the arm extends generally horizontally, and the strut extends generally vertically to a retracted or collapsed position, wherein the arm extends generally vertically adjacent the side of the chair back, and the strut extends generally horizontally adjacent the edge of the chair seat.

In a preferred arrangement, the arm is pivotally attached to the chair back and pivotally attached to the upper end of the strut, the lower end of the strut is pivotally attached to the chair seat or its support structure, and the chair back is vertically slidable on a chair back support. With this arrangement, and in accordance with the method of the invention, the chair back can be easily slidably raised on it support, moving the arm and the strut to a temporary straight position and then pivoting the forward end of the arm and the upper end of the strut rearwardly and downwardly as the chair back slides downwardly to its normal position.

Advantageously, the chair back and arm may be easily moved to or from its two positions while the occupant is seated in the chair. Also, one arm can be moved to its retracted position while the other remains in its raised position for situations i which such an arrangement is desired. Also, a series of chairs in side-by-side relation can be easily ad to so-called bench seating.

SUMMARY OF THE DRAWINGS

FIG. 1 is perspective view of the chair of the invention with arms in a raised position.

FIG. 2 is a perspective view of the chair of FIG. 1 with the arms in a position midway between the raised position and a retracted position.

FIG. 3 is a perspective view of the chair of FIG. 1 with the arms in a retracted position.

FIG. 4 is a perspective view of the chair illustrating its backside.

FIG. 5 is an exploded perspective view of the chair back and chair seat support structures.

FIG. 6 is a perspective view of the support structure of FIG. 5 in assembled condition.

FIG. 7 cross-sectional view of the chair back on line 7—7 of FIG. 6.

DETAILED DESCRIPTION OF THE PREFERRED EMBODIMENT

Figure 8:
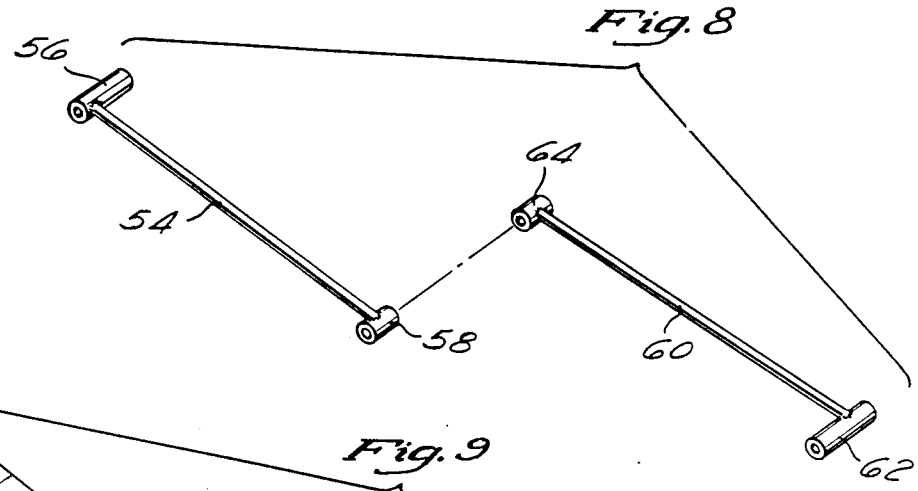
FIG. 8 is an exploded perspective view of the chair arm and support strut internal construction.

The operation of the chair of the invention may be readily understood by reference to FIGS. 1–4. The chair includes a chair seat 10, a chair back 12, including a back support 14 and a backrest 16, a pair of arms 18 and a pair of arm support struts 20. The chair seat 10 is mounted on a suitable support such as a pedestal 22 with an adjustable control unit 24 schematically illustrating a connection between the pedestal 22 and the chair seat 10.

In FIG. 1, the chair arms 18 are raised into a normal support position wherein they extend generally horizontally spaced above the seat 10 as supported by the struts 20 and the backrest 16. The backrest 16 is slidably mounted on its support so that it can be raised to the position shown in FIG. 2, allowing the pivotal connection between the arms and the struts to be moved rearwardly into the temporary straight position illustrated in FIG. 2. As the chair back is lowered to its normal position as shown in FIG. 3, the chair arms pivot to a retracted position wherein the chair arms are vertically oriented to the sides of the chair backrest, and the struts are horizontally oriented to the sides of the chair seat. Thus, the arms are conveniently out of the way for situations in which that condition is desired, such as moving the chair beneath a table which would interfere with the arms. When it is desired that the armrests be returned to the condition of FIG. 1, the procedure is simply reversed. In some situations, it is desirable to have a single armrest in a raised position and the other in its retracted or collapsed position. This is easily accomplished when the chair is in the position of FIG. 2 by moving one connection between one arm and its strut rearwardly while moving the connection between the other arm and its strut forwardly.

The form of the chair illustrated is primarily intended for industrial, commercial or office use and formed with material providing a plastic-like exterior, with such material being integrally molded to interior support frames made of steel or other suitable material. As seen in FIGS. 5 and 6, the chair seat includes a pair of spaced support plates 30 that extend horizontally toward the side edges of the seat. These plates are rigidly connected to a pair of horizontally spaced support elements 32 that extend toward the front and back edges of the seat, thus creating a generally rectangular frame. Holes are formed in the ends of the plates for receiving fasteners for connecting that frame to the control unit on the upper end of the pedestal or other support base for the chair.

A further support member 34 for the chair seat is attached to the elements 32 with such member extending from one side edge of the seat to the other. Sturdy tubular sockets 36 are welded to the outer ends of this member with the sockets opening outwardly to receive pivot pins.

Rigidly attached to the rear support plate 30 is by suitable fasteners one end of a J-shaped support strap 42 having a horizontal portion **42*a* which curves smoothly into a vertical portion 42*b*. As seen from FIG. 6, the horizontal portion 42*a* together with the other seat components referred to above are embedded in the plastic shell 11** which is integrally molded around these components.

The support strap 42 is the back support for the backrest. The backrest includes the outer plastic shell **12*a* which is molded integrally around a horizontally extending back support 46. The shell is also molded around a pair of vertically extending angle pieces 48 that are rigidly attached to the horizontal member 46 and are rigidly attached at their upper end to a connecting rod 50 in a manner such that the central portion 46*a* of the horizontal member, the two angled elements 48 and the rod 50 form a rigid channel adapted to slidably receive the vertical portion 42*b* of the back support strap. To accomplish this, the back shell is, of course, also formed with a flat vertically extending pocket 51 through which the back strap extends, as shown in FIGS. 6 and 7. Tubular pin receiving sockets 52** are formed in the outer ends of the back horizontal support, the sockets opening to the side edges of the backrest.

Figure 9:
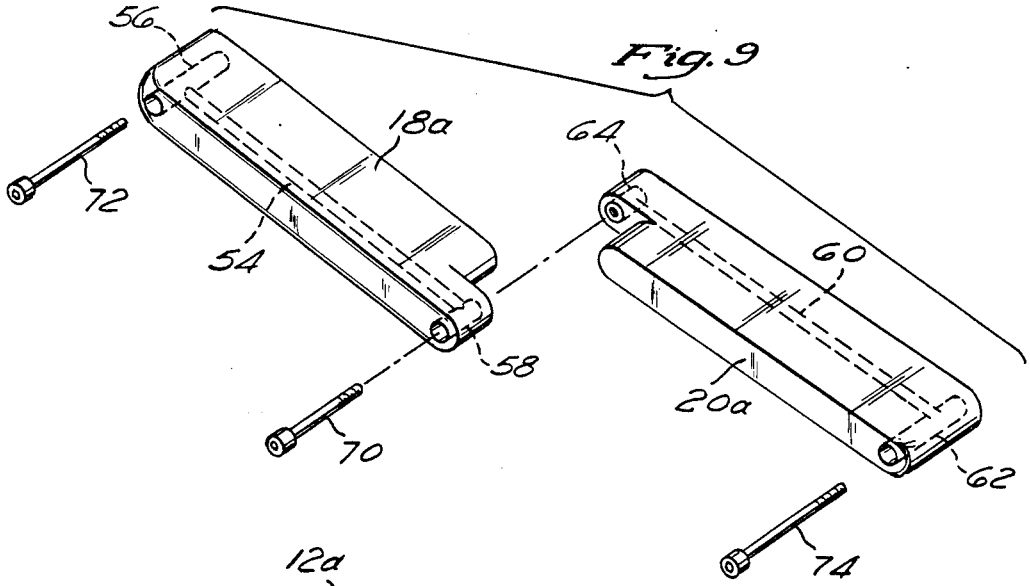
FIG. 9 is an explode perspective view of the chair arm and support strut.
Figure 10:
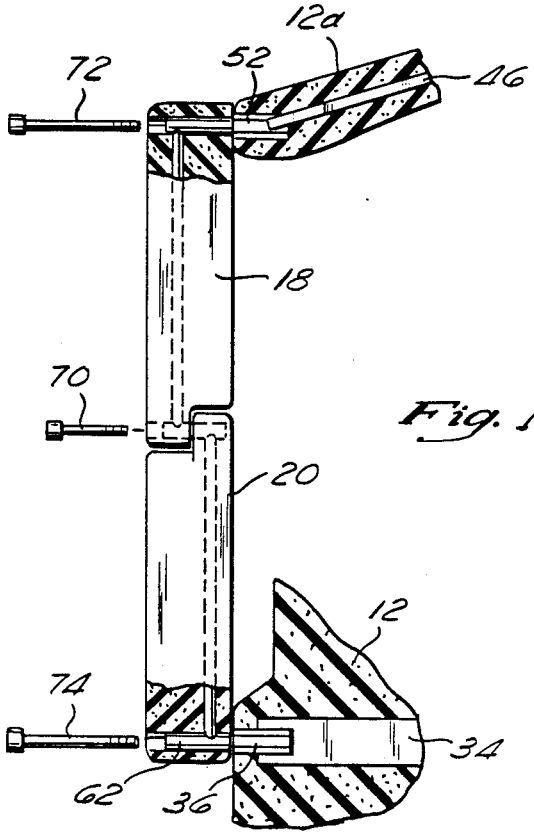
FIG. 10 is a partially exploded, partially sectionalized view illustrating the pivotal connections between the chair components.

Referring to FIGS. 8 and 9, each chair arm 18 includes a support rod 54 having a pin receiving tube 56 on the rear end of the rod, and a shorter pin receiving tube 58 attached to the forward end of the arm. The arm support strut 20 includes a rod 60 having a pin receiving tube 62 on its lower end and a smaller pin 64 receiving tube on its upper end. In a preferred form of the invention, the arm rod 54 and the strut rod are identical except that the tube 64 is threaded and the tube 58 need not be. This means that the length of the strut and the arm 18 are the same so as to accommodate the movement of the arms between the support and the retracted positions. A plastic exterior shell 18 for the arm and a similar shell 20 for the strut are molded about the arm and strut rods creating the shapes illustrated in FIG. 9. Note that the forward portion of the arm shell is only half as wide as the balance of the arm, and that the upper end of the arm strut is only half as wide as the rest of the strut, so that these ends can fit together as shown in FIGS. 9 and 10. A pivot pin 70 extends through the tube 58 on the forward end of the arm 18 and threads into the tube 64 on the upper end of the strut 20, thereby forming a pivoted connection to these components at that location. Similarly, a pivot pin 72 extends through the tube 56 in the rear end of the arm and threads into the tube 52 on the edge of the backrest. Likewise, a pivot pin 74 extends through the tube 62 and on the lower end of the strut, and threads into the threaded tube 36 on the edge of the seat. While other movable connections between the components may be employed, the arrangements illustrated are particularly simple, sturdy and practical, as well as providing an attractive appearance.

What is claimed is:

1. A chair, comprising:

a chair seat;

a chair back positioned at the rear of said seat;

a rigid chair arm at the side of said seat having a rear end movably connected to and supported by said back; and a rigid arm support strut having an upper end movably connected to the forward end of said arm and having a lower end movably connected to said seat, said arm having a generally horizontal support position spaced above the seat wherein the strut supports the forward end of the arm and the back supports the rear end of the arm, and said arm having a collapsed position wherein the arm is in a generally vertical position aligned with the edge of the rear of the back and said strut is in a generally horizontal position adjacent to the edge of said seat.

2. The chair of claim 1, wherein the upper end of said strut is pivotally connected to said arm.

3. The chair of claim 1, wherein the upper end of said strut is pivotally connected to said arm, and the rear of said arm is pivotally connected to said back.

4. The chair of claim 1, wherein said back includes a back support connected to the seat, and a backrest vertically slidable on said back support so as to enable said arm to move from said support position to said collapsed position.

5. The chair of claim 4, wherein the upper end of said strut is pivotally connected to said arm, the rear of said arm is pivotally connected to said backrest.

6. The chair of claim 5, wherein said backrest includes an interior, generally flat, vertically oriented pocket open to the lower end of the backrest to slidably receive said back support.

7. The chair of claim 1, wherein said arm is about equal in length to said strut.

8. A chair, comprising:

a support pedestal;

a chair seat fixed to the pedestal;

a chair back support secured to the pedestal and extending upwardly at the rear of said seat;

a chair backrest vertically slidable on said chair back support;

an armrest pivotally connected to the chair backrest at a point spaced above the seat a distance about equal to the length of the armrest; and an armrest support strut having its lower end pivotally connected to the edge of said chair seat with its upper end pivotally connected to the forward end of the armrest, the length of said strut being about equal to the length of said armrest;

said armrest being pivotable from a raised position adapted to support the chair occupants arm to a collapsed position not adapted to support the occupants arm, said chair backrest being vertically slidable on said chair back support when the armrest is moved between said support and said collapsed positions.

9. A chair, comprising:

a chair seat;

a chair back positioned at the rear of said seat wherein said back includes a back support connected to the seat wherein said back includes a back support connected to the seat, and a backrest vertically slidable on said back support;

a chair arm at the side of said seat having a rear end movably connected to and supported by said back; and an arm support strut having an upper end connected to the forward end of said arm and having a lower end movably connected to said seat, said arm having a generally horizontal support position spaced above the seat wherein the strut supports the forward end of the arm and the back supports the rear end of the arm, and said arm being capable of moving to a retracted position, enabled by the vertical sliding of the backrest, wherein the arm is in a generally vertical position aligned with the edge of the rear of the back and said strut is in a generally horizontal position adjacent to the edge of said seat.

10. The chair of claim 9, wherein said strut is movably connected to the forward end of said arm.

11. The chair of claim 10, wherein the upper end of said strut is pivotally connected to said arm.

12. The chair of claim 9, wherein the rear of said arm is pivotally connected to said back, and said lower end of said strut is pivotally connected to said seat.

13. The chair of claim 9, wherein said backrest includes an interior, generally flat, vertically oriented pocket open to the lower end of said backrest to slidably receive said back support.

14. A chair, comprising:

a chair seat;

a chair back positioned at the rear of said seat;

a chair arm at the side of said seat having a rear end movably connected to and supported by said back; and an arm support strut having an upper end pivotally connected to the forward end of said arm and having a lower end movably connected to said seat, said arm having a generally horizontal support position spaced above the seat wherein the strut supports the forward end of the arm and the back supports the rear end of the arm, and said arm having a retracted position wherein the arm is in a generally vertical position aligned with the edge of the rear of the back and said strut is in a generally horizontal position adjacent to the edge of said seat.

15. The chair of claim 14, wherein said back includes a back support connected to the seat, and a backrest vertically slidable on said back support so as to enable said arm to move from said support position to said retracted position.

16. A chair, comprising:

a chair seat;

a chair back positioned at the rear of said seat;

a chair arm at the side of said seat having a rear end movably connected to and supported by said back; and an arm support strut having an upper end pivotally connected to the forward end of said arm and having a lower end movably connected to said seat, said arm having a generally horizontal support position spaced above the seat wherein the strut supports the forward end of the arm and the back supports the rear end of the arm, and said arm capable of moving into a retracted position upon the upward movement of the rear end connection to said back, wherein the arm is in a generally vertical position aligned with the edge of the rear of the back and said strut is in a generally horizontal position adjacent to the edge of said seat.

17. A method of moving a chair arm from a raised generally horizontal position adapted to support the chair occupant's arm, to a retracted position not adapted to support the occupant's arm, wherein the chair has a back which includes a backrest and a backrest support, said method comprising:

sliding the chair back upwardly on the chair back support, thereby raising a connection between the chair backrest and the rear of the arm;

moving a connection between the forward end of the arm and the upper end of the strut downwardly and rearwardly until the arm and the strut are essentially in linear alignment; and continuing the movement of the connection between the forward end of the armrest and its support strut in a rearwardly and downwardly direction, thereby lowering the chair back on the back support and moving the arm to its retracted position.

18. A method of moving a chair ar from a raised generally horizontal position adapted to support the chair occupant's arm, to a retracted position not adapted to support the occupant's arm, wherein the arm is pivotally connected to a support strut, said method comprising:

pivoting the arm and the support strut relative to each other so as to move the arm to a position wherein it extends vertically adjacent a chair back and to move the support strut to a position wherein it extends horizontally adjacent the edge of a chair seat while the arm extends vertically.

19. A method of moving a chair arm from a generally horizontal support position to a generally vertical retracted position wherein the forward end of the arm is connected to a support strut and the rearward end is movably connected to the back of the chair, said method comprising:

raising the connection between the arm and the back;

moving the connection between the arm and the strut downwardly and rearwardly; and continuing the movement of the connection between the arm and the strut, thereby lowering the connection between the arm and the back and moving the arm to its retracted position.

* * * * *